US006892690B2

(12) United States Patent
Gabriel et al.

(10) Patent No.: US 6,892,690 B2
(45) **Date of Patent: *May 17, 2005**

(54) COOLING CHANNEL COVER FOR A ONE-PIECE PISTON OF AN INTERNAL COMBUSTION ENGINE

(75) Inventors: Dieter Gabriel, Highland, MI (US); Michael T. Lapp, Bloomsfield, MI (US)

(73) Assignee: Mahle GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/679,587

(22) Filed: Oct. 6, 2003

(65) Prior Publication Data

US 2005/0072394 A1 Apr. 7, 2005

(51) Int. Cl.[7] ..... F02F 3/22
(52) U.S. Cl. ..... 123/193.6
(58) Field of Search ..... 123/193.6, 41.35; 92/186, 159, 1, 185, 190; 29/888.04, 888.045, 888.049

(56) References Cited

U.S. PATENT DOCUMENTS

| | | | | |
|---|---|---|---|---|
| 4,986,167 A | * | 1/1991 | Stratton et al. | 92/186 |
| 5,052,280 A | * | 10/1991 | Kopf et al. | 92/186 |
| 5,144,923 A | | 9/1992 | Leites et al. | |
| 5,261,363 A | | 11/1993 | Kemnitz | |
| 5,357,920 A | * | 10/1994 | Kemnitz et al. | 123/193.6 |
| 5,394,819 A | | 3/1995 | Aarnio | |
| 5,546,896 A | * | 8/1996 | Zaiser | 123/193.6 |
| 5,778,533 A | | 7/1998 | Kemnitz | |
| 5,778,846 A | * | 7/1998 | Mielke | 123/193.6 |
| 6,322,080 B1 | * | 11/2001 | Feistel | 277/490 |
| 6,453,797 B1 | * | 9/2002 | Bauer | 92/186 |
| 6,659,062 B1 | * | 12/2003 | Issler | 123/193.6 |
| 6,722,263 B2 | * | 4/2004 | Keller et al. | 92/186 |

FOREIGN PATENT DOCUMENTS

| | | |
|---|---|---|
| DE | 252 638 | 12/1987 |
| DE | 41 34 530 | 5/1992 |
| DE | 40 39 751 | 6/1992 |
| DE | 42 08 037 | 3/1998 |
| EP | 0 561 871 | 11/1995 |
| EP | 0 799 373 | 1/1999 |

OTHER PUBLICATIONS

International Standard ISO 1043–1 dated 1997.

* cited by examiner

*Primary Examiner*—Marguerite McMahon
(74) *Attorney, Agent, or Firm*—Collard & Roe, P.C.

(57) ABSTRACT

A cooling channel cover for a one-piece piston of an internal combustion engine, the piston having a closed cooling channel that runs around inside the piston crown, at the level of the piston ring band, and a ring-shaped recess provided between the piston ring band and the piston shaft, wherein the piston shaft is connected with the piston hubs suspended on the piston crown. In such a piston, an easy to assemble cooling channel cover is achieved by means of a one-piece plastic/spring steel ring that is U-shaped in cross-section.

8 Claims, 1 Drawing Sheet

COOLING CHANNEL COVER FOR A ONE-PIECE PISTON OF AN INTERNAL COMBUSTION ENGINE

BACKGROUND OF THE INVENTION

1. Field of the Invention

The invention relates to a cooling channel cover for a one-piece piston of an internal combustion engine, the piston having a closed cooling channel that runs around inside the piston crown, at the level of the piston ring band, and a ring-shaped recess provided between the piston ring band and the piston shaft. The piston shaft is connected with the piston hubs suspended on the piston crown.

2. The Prior Art

A multi-part cooled piston having a cooling channel arranged in the edge region of the piston head is described in German Publication DE 40 39 751 A1. This channel is covered with a sheet-metal ring essentially structured like a cup spring. This sheet-metal ring is structured in one piece and can be easily assembled with the piston only because the piston is structured in two parts. It is necessary to assemble the sheet-metal ring with the upper piston part first, before the upper piston part is connected with the lower piston part.

Furthermore, pistons are known from German Publication No. DD 252 638 A1 and German Publication No. DE 41 34 530 A1, in which a wall part that covers the cooling channel that is open to the bottom, and runs around the circumference in ring shape, is structured as an open sheet-metal ring, which rests in a groove against the inside circumference of the piston ring zone, and against the outside circumference of the combustion chamber wall, respectively, taking advantage of its plastic deformation according to the Seeger ring principle, i.e. biased in the radial direction.

Furthermore, a multi-part piston having a cooling channel is known from German Patent No. DE 42 08 037 C2, in which the cooling channel, which is open to the bottom, is covered by means of a biased cup spring, which is divided into at least two parts on its circumference, and rests freely on supports against axially opposite sides, radially on the inside and the outside.

Finally, one-piece cooling channel pistons having a cooling channel arranged in the edge region of the piston head are known from European Patents Nos. EP 0 561 871 B1 and EP 0 799 373 B1, which channel is also closed off with cover rings structured like cup springs, or cover rings structured like cup springs and provided with a collar.

In this connection, a disadvantage of the aforementioned embodiments is that the cover ring or cup spring must be structured in two parts, in order to be able to be assembled. Furthermore, during assembly each of the two semi-circular ring halves must be individually introduced into corresponding bearings on the piston crown, in the biased state.

SUMMARY OF THE INVENTION

It is therefore an object of the invention to create a cooling channel cover for a one-piece piston of an internal combustion engine, which cover can be installed easily and quickly, whereby the piston weight is reduced as compared with the known state of the art.

This task is accomplished by means of a one-piece plastic or spring steel ring made from polyphenylene sulfide (PPS) or a high-temperature polyimide (PI), which is formed to be U-shaped in cross-section. In particular, the U-shaped ring has a ring bottom, an outer shank around the circumference of the ring, molded onto the ring bottom and angled off radially to the outside, and an inner shank around the inner circumference of the ring, angled off radially to the inside. Both shanks permit radial deformation in such a manner that in order to close off the cooling channel, the shanks engage in a conical recess of the cooling channel made on the inner edge of the cooling channel, essentially without bias, causing the ring bottom to close off the cooling channel.

In a preferred embodiment, slits that extend close to the ring bottom are made in the radially outer and radially inner shanks. The slits are non-uniformly distributed over the circumference, in order to produce a plurality of shanks having different ridge lengths (L). The slits preferably have a width of 2 to 3 mm and the ridge lengths are preferably 15 to 20 mm.

Preferably, the U-shaped ring is radially divided in such a way that a mouth width is formed to form a cooling oil inlet or a cooling oil outlet for the cooling channel.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
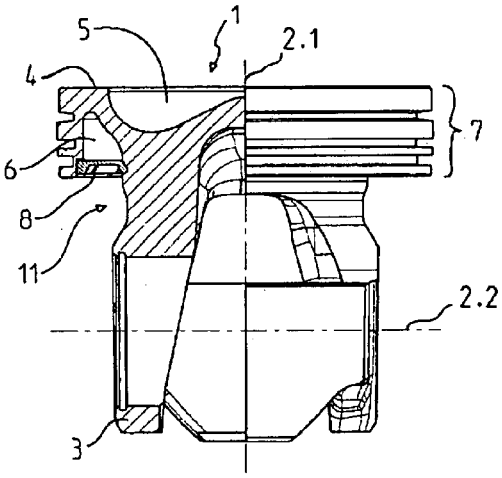
FIG. 1 shows a one-piece piston for an internal combustion engine, having a cooling channel that is closed off by a U-shaped ring according to the invention, shown in a cross-sectional diagram that consists of two halves, which shows two longitudinal cross-sections of the piston, offset by 90°.
Figure 2:
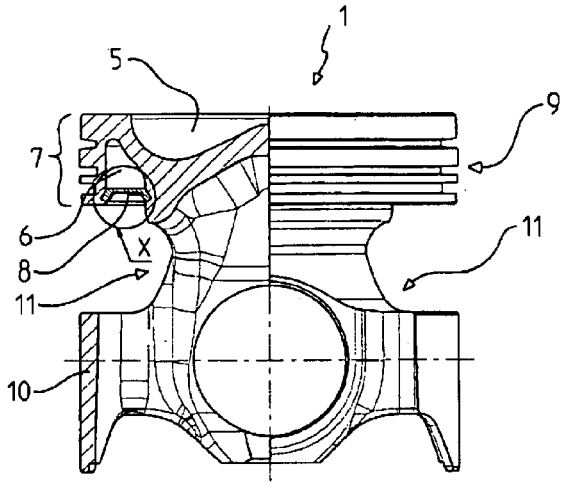
FIG. 2 shows a piston according to FIG. 1, rotated by 90°.
Figure 3:
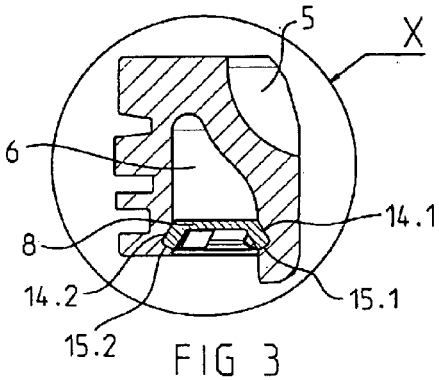
FIG. 3 shows a partial detail of the piston according to Detail X from FIG. 2.

Referring now in detail to the drawings, FIG. 1 shows a piston 1, structured in one piece, for an internal combustion engine, in a cross-sectional diagram that consists two halves, the left half representing a cross-section of piston 1 along a longitudinal axis 2 of the piston, and the right half representing a longitudinal axis of piston 1 that is offset from the former by 90°.

Piston 1 is made of steel and has a piston crown 9 having a piston ring band 7 and a piston head 4 having a combustion space depression 5. A piston shaft 10 is connected with piston hubs 3 suspended on the piston crown. At the level of piston ring band 7, a closed cooling channel 6 that runs around the circumference in ring shape is arranged in piston crown 9, the radial outer delimitation and radial inner delimitation of which channel are determined by the ring wall molded onto piston head 4 and by the piston crown region on which piston hubs 3 are suspended. The inside of cooling channel 6 has a recess 14.2 on the ring wall side and a recess 14.1 on the piston crown side, the wall regions of which result in a conically narrowed shape in the axial direction, towards the piston head 4. The incline, in each instance, is characterized by the angle between the axial piston axis 2.1 and the slant of the recess wall, which is approximately 30°. The recesses 14.1 and 14.2 are delimited by a step 15.1 and 15.2, in each instance, which also result in a conically narrowed shape in the direction towards piston shaft 10, and whose aforementioned defined angle has a value of approximately 20 to 30°.

A ring-shaped recess 11 is provided between piston ring band 7 and piston shaft 10, by means of which assembly for closing off cooling channel 6 via a one-piece U-shaped plastic/spring steel ring 8 takes place. According to the invention, a thermoplastic polymer plastic, such as polyphenylene sulfide (abbreviation: PPS), Ryton R4® or high-temperature polyimide (abbreviation: PI), such as VESPEL® from DuPont or AURUM® from Mitsui Chemicals Inc., is preferably used for this purpose. The abbreviations correspond to the international standard ISO 1043-1 dated 1997. Such plastics are characterized by their resistance to high temperatures, i.e. heat, of 200° C. to 400° C. in long-term operation. In addition, the plastic can also be fiber-reinforced. The spring steel can be a standard carbon steel like $C_R$ 75. Tempering is optional.

Figure 4:
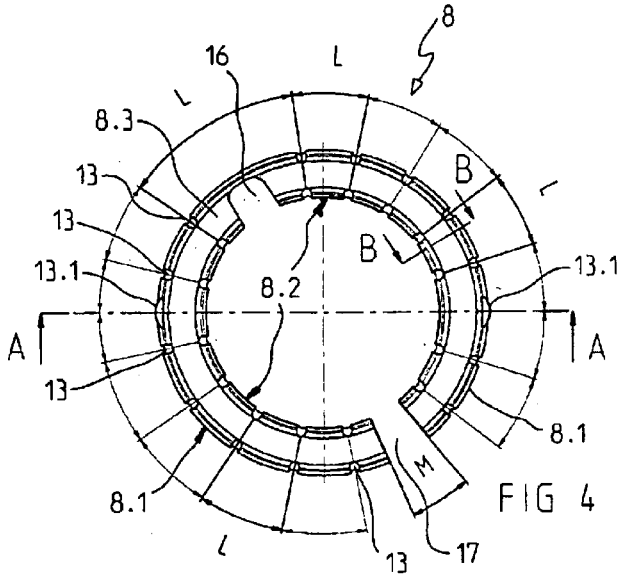
FIG. 4 shows a top view of the U-shaped plastic ring.

According to FIG. 4, U-shaped plastic ring 8 has a radial outer shank 8.1 angled away from its ring bottom 8.3, and a radial inner shank 8.2 angled away, which are divided by slits 13 non-uniformly distributed over the circumference, in order to simplify carrying out the assembly, so that shank segments L of different lengths are formed. The slits are made down close to the bottom 8.3 of the plastic ring 8 and have a slightly V-shaped form and a slit width of 2 to 3 mm. The aforementioned radial slitting takes place distributed over the circumference of the ring, preferably in an angle range between 15 and 25°.

Figure 6:
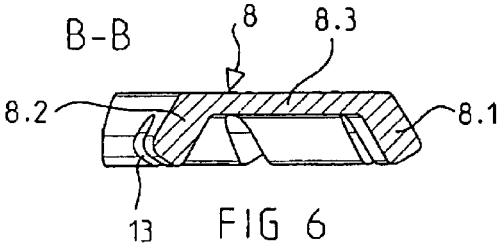
FIG. 6 shows a cross-section along the line B—B of the U-shaped ring according to FIG. 4.
Figure 5:
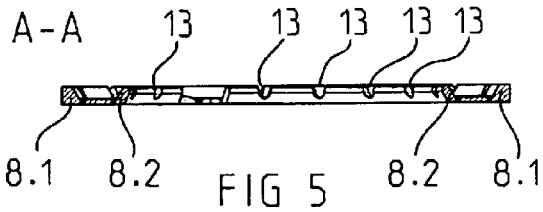
FIG. 5 shows a cross-section along the line A—A of the U-shaped ring according to FIG. 4.

As shown in the cross-sectional diagram according to FIG. 6, the outer shank 8.1 is arranged on the outside circumference of the ring bottom 8.3, and angled off radially to the outside with reference to the crosswise axis 2.2 of the piston, from the ring bottom 8.3, whereby the inner shank 8.2 is angled off radially towards the inside, and is arranged on the inside circumference of the piston bottom 8.3.

As is evident from FIG. 4, U-shaped plastic ring 8 is radially divided in such a way that an opening 17 with a mouth width M is formed. At 180° opposite to this there is a U-shaped opening 16 having approximately the same width. Both openings 16 and 17 serve as the oil inlet and oil outlet, respectively, in the assembled state of ring 8, to supply the cooling channel 6 with oil.

Assembly of ring 8 can take place in a simple manner, in that it is elastically bent up, on half its side, from its plane, up to a level that corresponds to the axial height of recess 11, introduced into the latter, and pushed over the hub region suspended on the piston crown. In this pre-assembled state, the ring is oriented towards the piston head with its ring bottom 8.3.

In order to close off cooling channel 6, ring 8 is subsequently pressed over steps 15.1 and 15.2, so that its shanks 8.1 and 8.2 come to rest on recesses 14.1 and 14.2, whereby the faces of the shanks are supported on the steps. In this state, the ring bottom 8.3 closes off the cooling channel 6. One or two projections 13.1 that can be arranged on the circumference, projecting on the circumference, opposite outer shank 8.1, and engage in recesses in the cooling channel, not shown, serve to prevent the U-shaped ring from rotating out of place.

Accordingly, while only a few embodiments of the present invention have been shown and described, it is obvious that many changes and modifications may be made thereunto without departing from the spirit and scope of the invention.

Reference Symbol List

1 piston
2.1 longitudinal piston axis
2.2 crosswise piston axis
3 hub bore
4 piston head
5 combustion space depression
6 cooling channel
7 piston ring band
8 U-shaped ring
8.1 radially outer shank
8.2 radially inner shank
8.3 ring bottom
9 piston crown
10 shaft
11 ring-shaped recess
13 slits
13.1 projections
14.1/14.2 circumferential recess
15.1/15.2 steps
16 cooling oil inlet
17 cooling oil outlet
M mouth width
L ridge length

What is claimed is:

1. A cooling channel cover for a one-piece piston of an internal combustion engine, having a closed cooling channel that runs around an inside region of a piston crown of the piston, at a level of a piston ring band, and a ring-shaped recess provided between the piston ring band and a piston shaft, wherein the piston shaft is connected with piston hubs suspended on the piston crown, the cover comprising a one-piece plastic or spring steel ring that is U-shaped in cross-section, said one-piece plastic or spring steel ring comprising:

a) a ring bottom;

b) an outer shank around a circumference of the cover, said outer shank being molded onto said ring bottom and angled off radially outwardly;

c) an inner shank around the circumference of the cover, said inner shank being angled off radially inwardly, wherein said inner and outer shank permit radial deformation in such a manner that in order to close off the cooling channel when said ring is mounted in the piston, said inner and outer shanks are adapted to engage in a conical recess of the cooling channel made on an inner edge of the cooling channel, essentially without bias, causing said ring bottom to close off the cooling channel; and d) slits extending close to said ring bottom made in said inner and outer shank, said slits being non-uniformly distributed over the circumference, in order to produce a plurality of shanks having different ridge lengths (L).

2. The cooling channel cover according to claim 1, wherein the U-shaped ring consists of polyphenylene sulfide (PPS) or a polyimide (PI).

3. The cooling channel cover according to claim 1, wherein the slits have a width of 2 to 3 mm and the ridge lengths are 15 to 20 mm.

4. The cooling channel cover, according to claim 1, wherein the U-shaped ring is radially divided in such a way that a mouth width is formed, said mouth width forming a cooling oil inlet or a cooling oil outlet for the cooling channel.

5. A one-piece piston of an internal combustion engine, comprising:

a piston crown;

a closed cooling channel that runs around an inside region of the piston crown at a level of a piston ring band;

a piston shaft connected with the piston crown via piston hubs on the piston crown;

a ring-shaped recess provided between the piston ring band and the piston shaft; and a cooling channel cover for covering the cooling channel comprising a one-piece plastic/spring steel ring that is U-shaped in cross-section, said one piece plastic/spring steel ring comprising:

a ring bottom:

an outer shank around a circumference of the ring, said outer shank being molded onto the ring bottom and angled off radially outwardly;

an inner shank around the circumference of the ring, said inner shank being angled off radially inwardly, wherein said inner and outer shank permit radial deformation in such a manner that in order to close off the cooling channel, said inner and outer shank engage in a conical recess of the cooling channel made on an inner edge of the cooling channel, essentially without bias, causing the ring bottom to close off the cooling channel; and slits extending close to the ring bottom made in said inner and outer shank, said slits being non-uniformly distributed over the circumference, in order to produce a plurality of shanks having different ridge lengths (L).

6. The piston according to claim 5, wherein the U-shaped ring consists of polyphenylene sulfide (PPS) or a polyimide (PI) or carbon spring steel.

7. The piston according to claim 5, wherein the slits have a width of 2 to 3 mm and the ridge lengths are 15 to 20 mm.

8. The cooling channel cover according to claim 5, wherein the U-shaped ring is radially divided in such a way that a mouth width is formed, said mouth width forming a cooling oil inlet or a cooling oil outlet for the cooling channel.

* * * * *